United States Patent [19]

Friedel

[11] 4,426,720

[45] Jan. 17, 1984

[54] DRIVE FOR ROTARY ANODES OF X-RAY TUBES

[75] Inventor: Rudolf Friedel, Kleinseebach, Fed. Rep. of Germany

[73] Assignee: Siemens Aktiengesellschaft, Berlin & Munich, Fed. Rep. of Germany

[21] Appl. No.: 265,672

[22] Filed: May 20, 1981

[30] Foreign Application Priority Data

Jun. 3, 1980 [DE] Fed. Rep. of Germany ..... 3021048

[51] Int. Cl.[3] ..... H05G 1/70

[52] U.S. Cl. ..... 378/93; 378/118

[58] Field of Search ..... 378/93, 94, 118

[56] References Cited

U.S. PATENT DOCUMENTS 3,062,960 11/1962 Laser ..... 378/93

3,205,360 9/1965 Graves ..... 378/93

4,225,787 9/1980 Shapiro ..... 378/94

FOREIGN PATENT DOCUMENTS 2158069 5/1973 Fed. Rep. of Germany .

*Primary Examiner*—Craig E. Church

*Attorney, Agent, or Firm*—Hill, Van Santen, Steadman & Simpson

[57] ABSTRACT

In an exemplary embodiment, to reduce wear on the bearings of a rotary anode during radiography processes which require a high load of the tube, such as e.g. all types of series techniques, a control of the rotational frequency of the anode is effected according to which the rotational speed of the anode drive motor is increased as a function of increasing thermal load on the anode plate. For this purpose there takes place, in a static frequency changer, an increase of the frequency of the alternating current with which the motor is driven. The motor drive frequency can, for example, be controlled in dependence upon the temperature of the anode plate as sensed by a measuring probe. An inventive drive of rotary anodes is particularly suited for use in the case of X-ray examination apparatus, especially computer tomographs.

5 Claims, 1 Drawing Figure

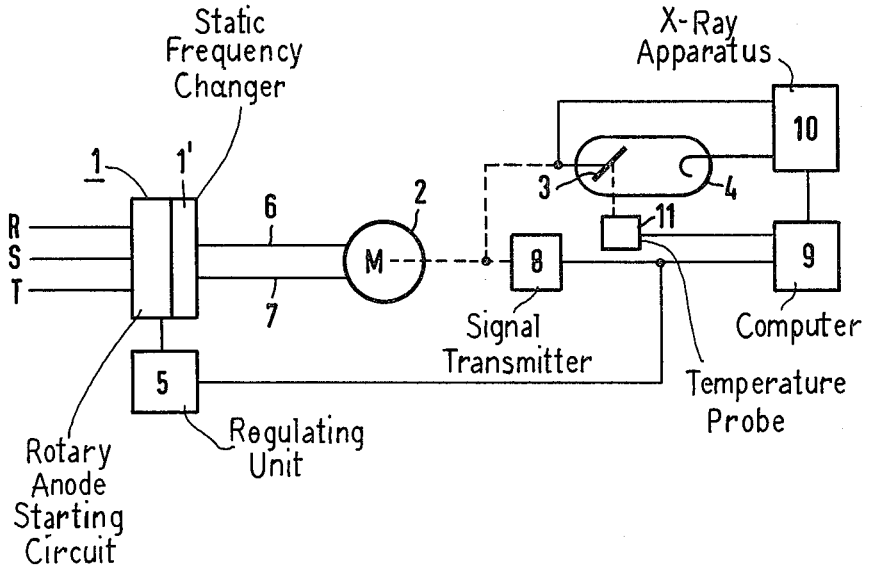
Static
Frequency
Changer
X-Ray
Apparatus
1
1'
10
3
4
6
2
11
R
S
T
M
8
9
7
Signal
Transmitter
Computer
5
Temperature
Probe
Regulating
Unit
Rotary
Anode
Starting
Circuit

DRIVE FOR ROTARY ANODES OF X-RAY TUBES

BACKGROUND OF THE INVENTION

The invention relates to a drive for rotary anodes of X-ray tubes according to the preamble of patent claim 1.

Rotary anodes are, as is known, driven with a constant angular velocity (rotational frequency) of the anode. In the case of presently conventional installations, these rotational rates correspond to frequencies of 50 Hz, 150 Hz or 300 Hz, respectively. In the case of conventional radiographs, this is a good idea because the exposure times are short here and one wishes to utilize the full tube power. After a complete radiograph the anode is again braked in order to keep the running times as short as possible and thus to preserve the ball bearings.

In a further development of the objective of preserving the ball bearings of rotary anode X-ray tubes, one could proceed from applying rotational speeds which are as low as possible. However, this would effect a reduction in the loading capacity because, as is known, the latter increases with increased rotational frequency. Therefore, it is not possible, in particular, in the case of the radiographic methods conventional today, which demand high power, to reduce the rotational speeds.

SUMMARY OF THE INVENTION

The object underlying the invention resides in providing, in the case of an X-ray tube with a rotary anode drive according to the preamble of patent claim 1, an arrangement which permits a preservation of the bearings, accompanied by a high loading capacity of the anode. This object is achieved in accordance with the invention by the features disclosed in the characterizing clause of claim 1.

In the case of all types of series operation, such as e.g. in the case of computer tomography and in the case of X-ray motion pictures, a large number of similar individual loads are successively connected in rapid sequence; e.g., in a time of approximately five to ten seconds (5 to 10 s); in certain circumstances even a greater number of such series follows one another in brief time intervals. The anode and, in particular, its ball bearings, are here strongly stressed thermally as well as mechanically with regard to the total running time.

In order to preserve the bearings of strongly stressed X-ray tubes, in accordance with the invention, the rotational frequency can be kept markedly lower at commencement of the load than the final rotational speed which must be attained, in the case of the adjusted power of the individual load, at the end of the series. This can proceed, for example, such that the rotational speed is increased in dependence upon the degree of thermal loading of the tube. As a measure of the necessary rotational frequency, the temperature of the anode plate can be utilized. The latter can be constantly measured by means of an indicator, for example, an optoelectronic transducer, such as a photoelectric cell or the like. Due to the supplied energy, on the other hand, it can also be ascertained by way of computation by utilizing the thermal characteristic values (or parameters) of the anode plate. To be understood here as thermal characteristics are e.g. the thermal capacity and the thermal radiation capacity of the anode. From the plate temperature and power the necessary frequency f can constantly be calculated from the relation $$f \sim \frac{N^2}{(T_{max} - T)^2}$$

T=plate temperature, N=power, $T_{max}$=maximum allowable focal spot temperature and a drive voltage of corresponding frequency can be supplied to the motor of the rotary anode via a starting apparatus.

From the German OS 2,158,069 a circuit arrangement for supplying the drive motor of the rotary anode of an X-ray tube is known in which a static frequency changer is provided which increases the frequency of the supply voltage in comparison to the mains frequency during the motor operation with the object of achieving as small as possible a start-up time. The control means for the static frequency changer contain a signal transmitter, which forms a signal corresponding to the r.p.m. of the motor, and a regulating unit, arranged at the output of the signal transmitter, associated with the static frequency changer, for the purpose of increasing the frequency of the supply voltage in dependence upon the motor r.p.m., in order to obtain as small as possible a start-up time; i.e., in order to obtain, in as brief a time as possible, the constant time per rotation considered necessary for the radiograph.

In accordance with the present invention, similar control means can be employed per se. The control itself, however, proceeds in such a manner that first driving is carried out to the r.p.m. necessary for the adjusted load, and that, only with increasing load, does an increase of the r.p.m. occur.

Further details and advantages of the invention shall be explained in the following on the basis of the embodiment schematically illustrated on the accompanying drawing sheet; and other objects, features and advantages will be apparent from this detailed disclosure and from the appended claims.

BRIEF DESCRIPTION OF THE DRAWING

The single FIGURE shows a rotary anode speed control circuit in accordance with the present invention.

DETAILED DESCRIPTION

In the drawing an X-ray apparatus with a rotary anode X-ray tube, constructed per se in a conventional fashion, is schematically illustrated. The FIGURE shows a starting apparatus 1 with a static frequency changer 1' which is connected to the three phases R, S and T of a three-phase power supply network. With its output voltage, the starting apparatus 1 with the static frequency changer 1' controls a single phase alternating current induction motor 2. This motor 2 serves the purpose of driving the rotary anode 3 of an X-ray tube 4. In the known embodiments presently generally employed, the tube 4 has a stator disposed at the exterior of the tube 4 with which stator, inside the tube 4, a rotor is associated which is connected with the shaft of the anode 3. For the purpose of improved clarity, the motor 2 is presently separately illustrated from the schematically illustrated tube 4.

Associated with the static frequency changer 1' is a regulating unit 5 by means of which the frequency of the supply voltage of the motor 2, i.e. the frequency of the voltage applied via lines 6 and 7, is variable. The regulating unit 5 is connected to the output of a signal transmitter 8 which is connected with a computer 9. The computer 9 receives signals from an X-ray apparatus 10 of the radiography arrangement and from a probe 11 thermally monitoring the anode which probe contains an optoelectronic element converting heat into electrical values. This is indicated by a broken connection line between the actual anode part of the rotary anode 3 and the probe 11. In the computer 9 it is possible to essentially continuously determine from the signals, in accordance with the above-cited formula, the necessary frequency from temperature and power. With the calculated control signal, the frequency of the feed voltage of the motor 2 is then regulated.

For film radiographs, for example, in the case of a cine series of 2400 radiographs which is made in forty seconds (40 s) with a power of 50 kW each and an exposure time of four milliseconds (4 ms) each, for an anode with a thermal capacity of 450 kWs, an acceleration from about 23 Hz to 150 Hz (over the time interval of forty seconds) has proven expedient if one proceeds from an unloaded anode 3. Thus, the series is commenced with an r.p.m. of approximately 25 Hz because, in the case of the latter, the power of 50 KW/4 ms on an almost cold anode plate is already permissible. At the end of the series a rotational rate of approximately 150 Hz is necessary in order to sufficiently distribute the impinging energy and in order to avoid an initial melting of the anode plate. The possible load is here sufficient in order to be able to make the above-cited series of 2400 radiographs.

An upper limit of the loading capacity is given by the r.p.m., which can be attained in the case of the available drive frequency and the mechanical stability of the tube 4, and the thus possible tube power. In the case of the present exemplary embodiment, the frequency of 150 Hz, which is maximally attainable with the static frequency changer 1' contained in the starting apparatus 1, is sufficient for the necessary rotational frequency of approximately 150 Hz.

It will be apparent that many modifications and variations may be effected without departing from the scope of the novel concepts and teachings of the present invention.

I claim as my invention:

1. A rotary anode drive system comprising an X-ray tube having a rotary anode, a rotary anode drive motor for driving said rotary anode, a circuit arrangement for the supply of a supply voltage to the rotary anode drive motor including at least one frequency changer means which varies the frequency of the supply voltage for the drive motor in comparison with the mains frequency, and a control circuit controlling said frequency changer means for increasing the rotational rate of the rotary anode drive motor by increasing the frequency of the supply voltage, said control circuit comprising thermal load determining means producing a control signal which varies as a function of time according to the variation in the thermal load on the rotary anode during operation of the X-ray tube, said thermal load determining means being connected with said frequency changer means for supplying said control signal to said frequency changer means to increase the rotational rate of the drive motor as a function of increasing thermal load on the rotary anode during operation of the X-ray tube.

2. A rotary anode drive system according to claim 1 with said thermal load determining means comprising a temperature sensor for sensing the temperature of the rotary anode.

3. A rotary anode drive system according to claim 2 with said temperature sensor being an optoelectronic element.

4. A rotary anode drive system according to claim 1, with said thermal load determining means repeatedly calculating the temperature of the rotary anode from the electrical energy supplied to the X-ray tube and the thermal characteristic values of the rotary anode.

5. A rotary anode drive system according to claim 2 with said thermal load determining means comprising a computer connected with said temperature sensor, said computer from the temperature of the rotary anode and the power supplied to the X-ray tube constantly calculating the necessary frequency for the supply voltage, said computer being connected with the frequency changer means for correspondingly increasing the frequency supplied by the frequency changer means to the rotary anode drive motor.

* * * * *